US005354120A

United States Patent [19]

Völkle

[11] Patent Number: 5,354,120

[45] Date of Patent: Oct. 11, 1994

[54] RECLINING CHAIR

[76] Inventor: Rolf Völkle, Hohenholz 1, W-7298 Lossburg, Fed. Rep. of Germany

[21] Appl. No.: 964,025

[22] Filed: Oct. 21, 1992

[30] Foreign Application Priority Data

Oct. 31, 1991 [DE] Fed. Rep. of Germany ..... 4135948
Mar. 14, 1992 [DE] Fed. Rep. of Germany ..... 4208227

[51] Int. Cl.[5] ..... A47C 1/032; A47C 3/021; A47C 3/026; A47C 7/44

[52] U.S. Cl. ..... 297/301; 297/300; 297/342

[58] Field of Search ..... 297/301, 300, 342

[56] References Cited

U.S. PATENT DOCUMENTS 3,036,862 5/1962 Beierbach et al. ..... 297/367
5,150,948 9/1992 Völkle ..... 297/301

FOREIGN PATENT DOCUMENTS 0036824 9/1981 European Pat. Off. .
0303720 4/1991 European Pat. Off. .
2642091 3/1978 Fed. Rep. of Germany .
2735583 2/1979 Fed. Rep. of Germany .
2822574 12/1979 Fed. Rep. of Germany .
3530868 3/1987 Fed. Rep. of Germany .
3930983 3/1991 Fed. Rep. of Germany .
2627968 9/1989 France .
87/06810 11/1986 PCT Int'l Appl. .

*Primary Examiner*—Alexander Grosz
*Attorney, Agent, or Firm*—Spencer, Frank & Schneider

[57] ABSTRACT

In a reclining chair a seat carrier and a reclining backrest carrier are movably interconnected to perform synchronized shifting movements relative to the frame of the chair. The bottom end portion of the backrest carrier extends under the seat carrier. Connecting means connect the seat carrier and the backrest carrier to each other and cause them to move at the same time. When the body of a person sitting on the seat carrier initiates a shifting movement of the backrest carrier from a steep position to a reclined position, the seat carrier will be moved forwardly at the same time and at least its rear portion will be lowered. Because the backrest carrier and the seat carrier are connected to the connecting means at spaced apart points, any movement of one of said carriers will be transmitted to the connecting means and by the latter to the other carrier. In spite of their connection by the connecting means the two carriers are guided on the frame along paths which are independent of each other. During the reclining movement the backrest carrier is lowered to an at least slightly larger extent than the seat carrier adjacent to the latter. As a result, an inexpensive reclining chair is provided, which can conveniently be moved to a reclined position for a comfortable rest.

24 Claims, 12 Drawing Sheets

RECLINING CHAIR

BACKGROUND OF THE INVENTION

1. Field of the Invention

This invention relates to a reclining chair, particularly an office swivel chair, comprising a frame, a seat carrier, and a backrest carrier having an adjustable inclination, which carriers are connected to the frame for performing a synchronous movement relative to the frame, wherein the backrest carrier at its bottom end extends under the seat carrier and is connected to the seat carrier by at least one connecting element for moving simultaneously with the seat carrier. The arrangement is such that a person sitting on the chair is adapted to perform a movement by which the backrest carrier is moved from a steep position to a reclined position and by said movement the backrest carrier is lowered and the seat carrier is moved forwardly at the same time and at least the rear portion of the seat carrier is lowered.

2. Description of the Prior Art

Published German Application 39 30 983 discloses such a chair in which a synchronous movement can be performed, by which the seat carrier is moved forwardly and its rear portion is lowered and the backrest carrier is reclined. That movement is imparted to the chair by synchronizing levers, which involve a complicated mechanism. Besides, the backrest carrier and the seat carrier are interconnected by pivot means so that the two parts cannot be moved independently of each other. Whereas the provision of the synchronizing levers, which are pivoted at a plurality of points, has the result that the relative movement of the backrest and the seat, which movement promotes the shirt-stripping effect, is substantially reduced, that relative movement cannot entirely be eliminated because the two carriers are directly interconnected.

In accordance with Published German Application 26 42 091 the bottom end of a backrest carrier is guided by an arcuate track, which extends below the seat. The track may be constituted by sleeves or by guiding rollers, which roll in corresponding slots. The backrest carrier is moved about an imaginary axis, which extends through the hip joints of the user. But because the seat carrier cannot be displaced forwardly so that the center of gravity of the user cannot be displaced, the backrest can be reclined only to a limited extent. Besides, during the reclining movement it is inconvenient that the seat carrier is not lowered at least in its rear portion because the shirt-stripping effect will thus be promoted, which is due to the raising of the backrest carrier relative to the back of the user.

EP 0 303 720 discloses a reclining chair in which an L-shaped backrest carrier is moved along two guides from a steep position to a reclined position. During that movement the top end of the backrest carrier is lowered and, at the same time, the seat carrier, which is directly connected to the backrest carrier by a pivot, is moved forwardly and its rear portion is slightly lowered. But the forward portion of the guide for the backrest carrier is so designed that the forward portion of the seat carrier is undesirably raised during the reclining movement. Because the backrest carrier is L-shaped, it is guided during its reclining movement by two guides. Whereas said guides still permit a movement about an imaginary axis, the large radius determined by the guides requires that axis to be substantially stationary and to be disposed on the chest or belly level in front of the user at a small distance from him. The backrest carrier and the seat carrier cannot move independently of each other because they have a common pivotal axis.

Published European Patent Application 36 824 and WO 87/06810 disclose reclining chairs in which a relative movement about an imaginary axis through the hip joints of the user is imparted to the seat and the backrest. Said chairs are not designed to permit a displacement of the center of gravity and it is difficult to guide the backrest carrier relative to the seat carrier along an arc because this might result in an overcenter movement of the backrest carrier. For this reason, adjusting mechanisms are provided, by which the movement of the backrest carrier is restrained.

SUMMARY OF THE INVENTION

In view of the prior art discussed hereinbefore it is an object of the invention to provide a reclining chair which is of the kind described first hereinbefore and which is designed to constitute an inexpensive chair, which has an attractive appearance and which can be moved to a highly comfortable reclined position.

That object is accomplished in that the backrest carrier and the seat carrier are connected to the connecting means at spaced apart points to transmit a movement to said connecting means and by said connecting means to each other and are mutually independently guided on the frame along paths which are independent of each other and during the reclining movement that intermediate portion of the backrest carrier which is adjacent to the seat carrier is lowered to an at least slightly larger extent than the rear end of the seat carrier.

The comfort afforded by a reclining chair will basically depend on the extent to which the backrest can be reclined. A factor which determines the comfort can be considered to be constituted by the relation of the contact pressures applied to the backrest and the meat in case of load cycles induced by a "dynamic sitting". In case of an office chair that maximum inclination is inherently limited by the largest permissible overhang of the backrest to the rear because a reclining movement of the backrest which is not accompanied by a forward displacement of the seat carrier will cause the center of gravity to be displaced away from the pivotal axis to such a large extent that the risk of a tilting of the chair will be increased. Besides, during the reclining movement of the backrest the rear portion of the seat carrier should desirably be lowered so that a relative movement of the seat and backrest, which would promote the shirt-stripping effect, will be avoided. Such a descend could readily be effected if the backrest and the seat carrier were moved in unison along a circular path but this would undesirably raise the front portion of the seat, on which the front portions of the thighs are supported, so that the legs might swell and suffer inconvenient sensations, such as that of pins and needles.

In accordance with the invention a reclining of the backrest carrier is accompanied by a forward movement of the seat carrier so that the center of gravity is displaced forwardly to such an extent that even a larger reclining movement can safely be effected without a need for long skids at the base of the chair for a support. The seat carrier is guided independently of the backrest carrier so that the undesired raising of the thigh-supporting portion is avoided. That design meets the requirements for an ergonomically desirable horizontal movement of the forward edge of the seat almost on a constant level.

The shirt-stripping effect tends to pull out the shirt of a user of the chair when he is using his body to recline the backrest and for that purpose forces his back against the backrest. That shirt-stripping effect is due to a relative movement of the backrest and the user's back, because the backrest is usually raised relative to the back of the user. In the use of the present chair that relative movement is not only reduced to zero but the backrest carrier is even lowered to a larger extent than the rear end of the seat carrier so that contrary to the known reclining chairs the backrest carrier is lowered relative to the back of the user and the shirt is thus pulled down.

The invention thus provides a comfortable seat furniture which can be reclined. Because the backrest carrier and the seat carrier are guided along different paths, the seat bucket is gently guided during said movement and in any intermediate position assumed during that movement the user can effect a weight-shifting change of his attitude, i.e., engage in a "dynamic sitting". There are large freedoms of movement and the backbone of the user may assume an extremely reclined position whereas the weight of the body is reliably supported on the anatomically designed seat bucket on large contact areas so that the contact pressures will be minimized. This will result in a maximum relaxation of the muscles of the belly and the diaphragm and will permit a breathing to a larger depth and a stronger pumping action of the heart. The resulting relaxation and the response of the circulatory system will effect a noticeable increase of the sitting comfort so that the health will be promoted. The seat carrier is moved along a separate path independently of the angular movement of the backrest carrier. When the backrest carrier is guided along an arc of a circle, it may sag; such sagging can be avoided so that the movement to the two end positions can be effected by a movement of the body of the user substantially without a need for additional means.

According to a preferred feature the backrest carrier is guided under the seat carrier along an arc. In that case it is possible to accompany the sliding operation by continuous movements about an axis which is fixed relative to the user and continual load cycles in the contact zones at the buttocks and the back of the user can provide additional freedoms of movement and increase the sitting comfort of the user. A guidance along an arc is provided by guiding means which comprise arcuate elements provided on the backrest carrier and moved along bearings fixed to the frame, or guiding means which comprise bearings provided on the backrest carrier and move along arcuate guides provided on the frame. The arc may be an arc of a circle or a segment of a hyperbola, parabola or a similarly curved segment of a geometric line.

According to a preferred feature of the invention the shifting movement is performed approximately about an imaginary axis, which extends through the hip joints of the user, and the seat carrier moves substantially under a horizontal plane, which is defined by the uppermost point of the seat carrier when the backrest carrier is in its steep position. In that case the relative movement between the user and the chair will be reduced.

According to preferred features the seat carrier is provided at its rear end with at least one roller, which rolls on a track provided on the frame and formed in the middle of its width with a longitudinal groove, and the roller is symmetrical and guided on an axle of the seat carrier and has in the middle of its length a radial rib, which extends into said groove. The roller may have its largest diameter at the rib and that diameter may linearly decrease toward the ends of the roller and the track may undulate in such a manner that it guides the roller first along a convex path and subsequently along a concave path as the backrest carrier is moved from its reclined position to its steep position. That roller may permanently be guided on a track because the periphery of the roller contacts the track only on minute areas. When the roller departs from its centered position, the outwardly decreasing diameter of the roller will result in a self-centering because the lateral movement will tend to increase the contact diameter and this will tend to effect a centering as in the case of rollers on correspondingly shaped railroad rails. In case of a correspondingly shaped track, the first part of the movement of the backrest carrier from its steep position will result in a larger relative movement of the seat carrier and the backrest carrier.

According to a preferred feature the backrest carrier, seat carrier and frame are interconnected by flexible tensile connecting means consisting of a rope or belt, which is secured to at least two of the three parts consisting of the frame, the seat carrier, and the backrest carrier, and may be fixed or relatively movably connected to the third of said parts. In conjunction with the above-mentioned track that arrangement will permit an optimum shifting movement whereas the belt will be tensioned in any position.

According to a preferred feature the flexible tensile element is fixed to the seat carrier and to the backrest carrier and is relatively movably connected to the frame by an axle, which is fixed to the frame and is at least partly wrapped by the flexible tensile element. Said axle may comprise an inner section, which is associated with the seat carrier and from which the rear portion of the flexible tensile element is being unwound during the movement of the backrest carrier to its steep position, and an outer portion, which is associated with the backrest carrier and on which the forward portion of the flexible tensile element is being wound up during the movement of the backrest carrier to its steep position, the inner section is smaller in diameter than the outer section and the axle serves also as a roller for guiding the backrest carrier, which drives the axle during its shifting movement. In that case the frame is provided with a fixed axle, which is so shaped that it can influence and coordinate the desired relative movements between the backrest carrier and the seat carrier. The flexible tensile element may consist of a belt, rope or the like, which can be wound up. In a preferred embodiment a stretchable rope is provided, which during the shifting movement is wound up on one section of the axle and unwound from the other section of the axle. It will be understood that two ropes may be used and that two different axles may be used.

A special coordination will be possible if the axle consists of two sections which differ in diameter. Because during the shifting movement the backrest carrier must move to a larger extent than the seat carrier moved at the same time, that section of the axle which is associated with the backrest carrier is larger in diameter so that the required convolutions of the rope associated with the backrest carrier can be accommodated within a smaller space. The axle serves also as a roller for guiding the seat carrier so that the axle will be driven. A single rope may be used, which can simply be inserted into the axle from one side through a central bore having radial access openings so that the rope exits on the other side of the bore.

In all embodiments the provision of a mechanism consisting only of a few elements permits the entire mechanism of the reclining chair to be sheathed with inexpensive means so that the chair will have an extremely attractive appearance and may have a slender outline in front elevation.

DETAILED DESCRIPTION OF THE PREFERRED EMBODIMENTS

Figure 1:
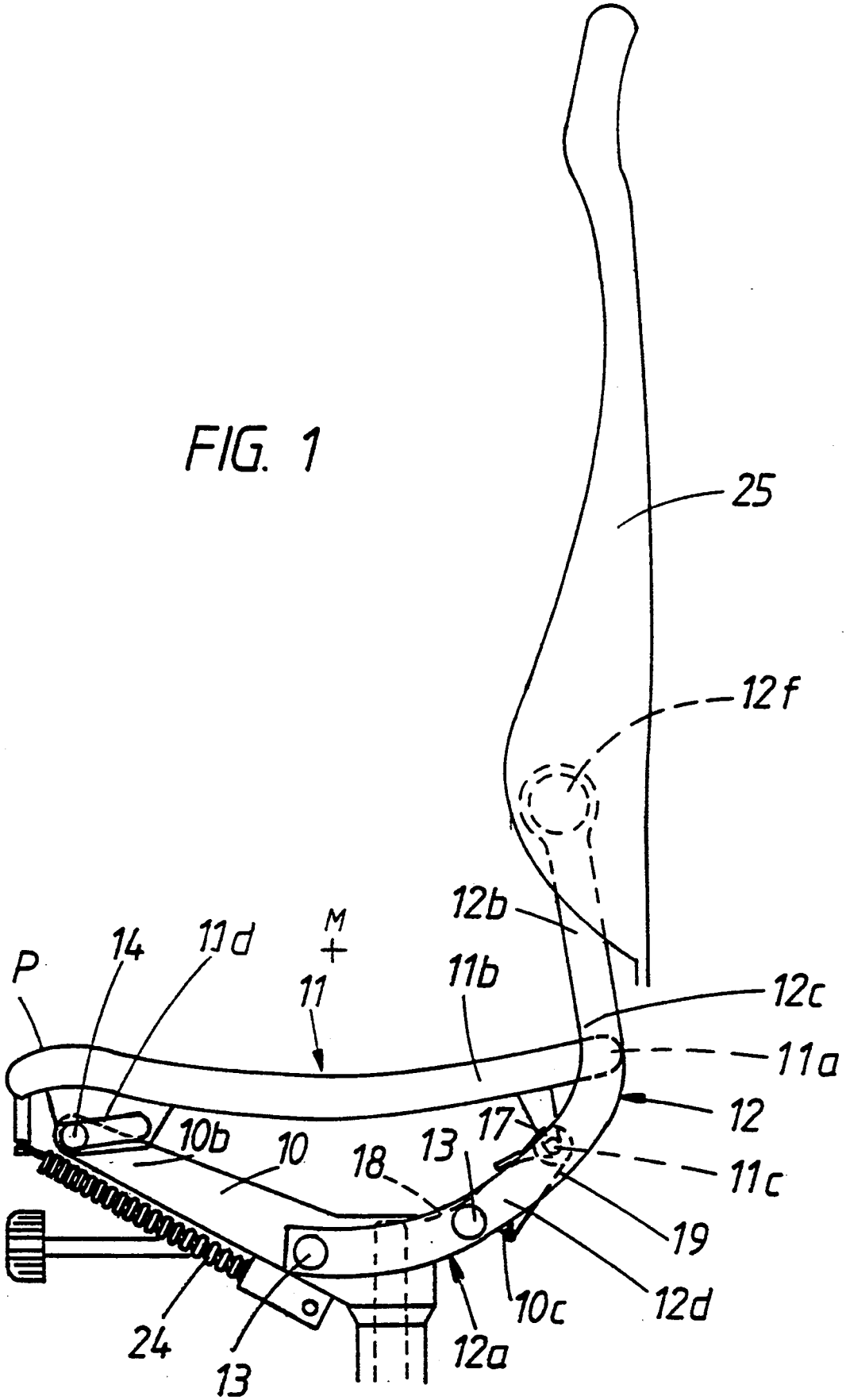
FIG. 1 is a schematic side elevation showing a first embodiment of the reclining chair in position for work.

Illustrative embodiments of the invention will now be described more in detail with reference to the drawings.

Three illustrative embodiments of the chair are shown in the drawings. The reclining chair is preferably used as an office swivel chair. The reference characters used for the second and third embodiments differ from those for the first embodiment in that those of the first embodiment are preceded by a numeral "1" for the second embodiment and by the numeral "2" for the third embodiment, i.e., they exceed those for the first embodiment by 100 and 200, respectively.

In all embodiments shown, a seat carrier 11, 111 or 211 and a backrest carrier 12 or 112 or 212, which can be reclined to an adjustable extent, are movably connected to the frame 10 or 110 or 210 for a synchronized shifting movement relative to the frame. The bottom end portion 12*a* or 112*a* or 212*a* of the backrest carrier extends under the seat carrier. When the user by a movement of its body initiates a shift of the backrest carrier from a steep position for work to a reclined position, the upper portion 12*b* or 112*b* or 212*b* of the backrest carrier 12 or 112 or 212 is lowered. By a connecting element the seat carrier 11 or 111 or 211 and the backrest carrier 12 or 112 or 212 are so interconnected that during the shift to the reclined position that portion 12*c* or 112*c* or 212*c* of the backrest carrier which is adjacent to the seat carrier is lowered to an at least slightly larger extent than the rear end of the seat carrier, which at this time is moved forwardly whereas its rear portion 11*b* or 111*b* or 211*b* is lowered. The backrest carrier and the seat carrier transmit their movement to each other by means of a connecting element, to which they are connected at two spaced apart points so that said carriers can mutually independently be guided along paths which are independent of each other.

During the shift the backrest carrier is guided under the seat carrier along an arc approximately about an imaginary axis M on the level of the hip joints of the user.

Figure 3:
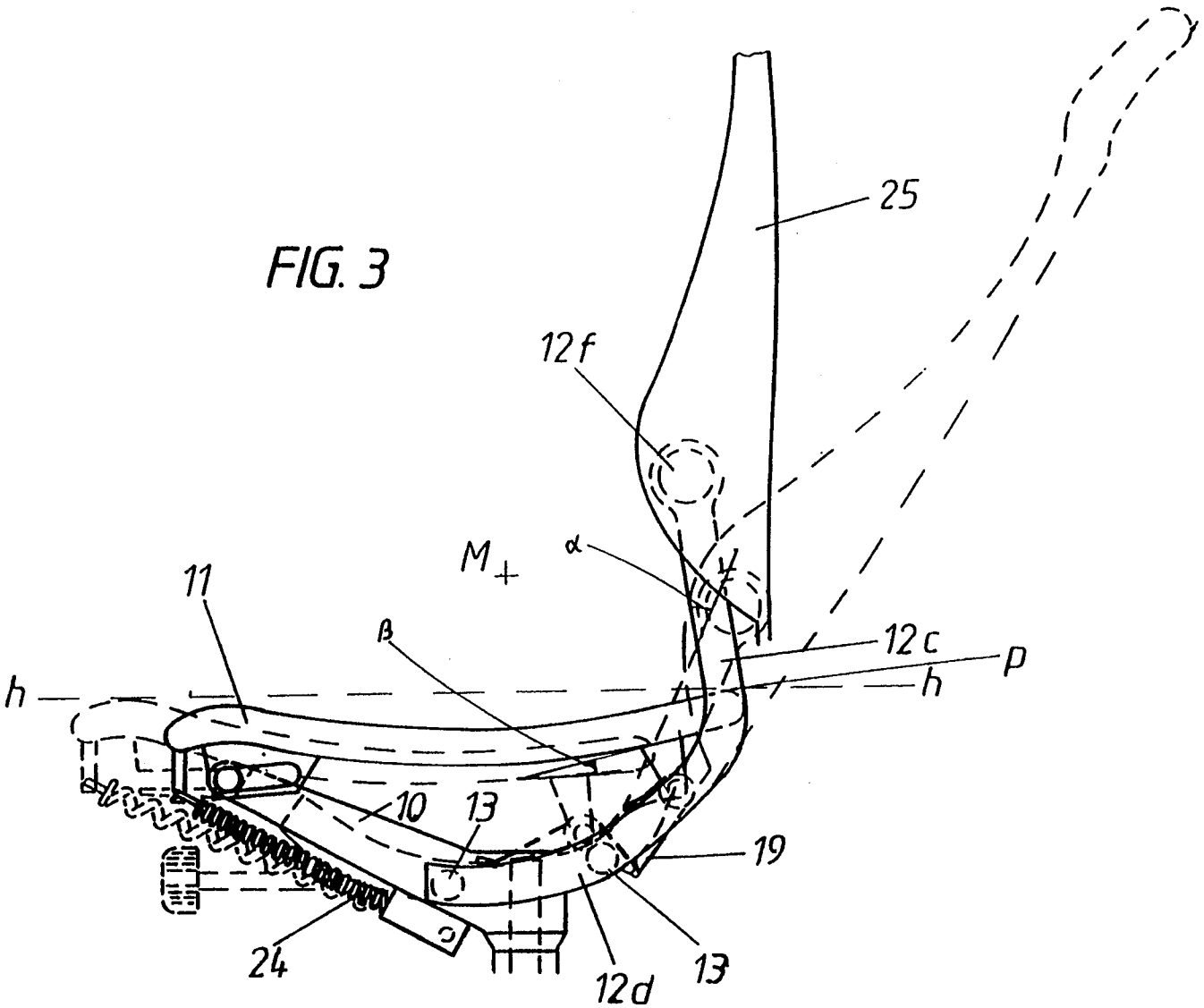
FIG. 3 is a view that is similar to FIGS. 1 and 2 and indicates the chair in its reclined position in broken lines and in position for work in solid lines.

The seat carrier 11 or 111 or 211 will always move forwardly during the reclining movement (FIG. 3). Owing to the arrangement of the means for guiding the seat carrier that movement takes place below a horizontal plane h—h, which is defined by the uppermost point P of the seat carrier when the backrest carrier is in its steep position. The forward portion of the seat carrier is guided by guide pin or a guide roller 14 or 114, which is provided on the frame 10 or 110 and on which a slot 11*d* or 111*d* of the seat carrier 11 or 111 is guided. That arrangement may obviously be inverted in that the guide slot is provided on the frame and is forwardly and downwardly inclined to prevent a raising of the forward edge of the seat. In the embodiment shown the guide slot 11*d* or 111*d* slides on the guide roller 14 or 114 with a changing inclination. Alternatively, the seat carrier 11 may be mounted on the frame 10 by means of at least one link, which is connected by respective pivots to the frame and to the seat carrier and which should be forwardly and downwardly inclined even when the backrest carrier is in its steep position. In a side elevation, the backrest carrier 12 has a lower arcuate bottom portion and an almost straight upper portion 12*b*, to which the backrest 25 is pivoted by the pivot 12*f* or 112*f*.

Figure 2:
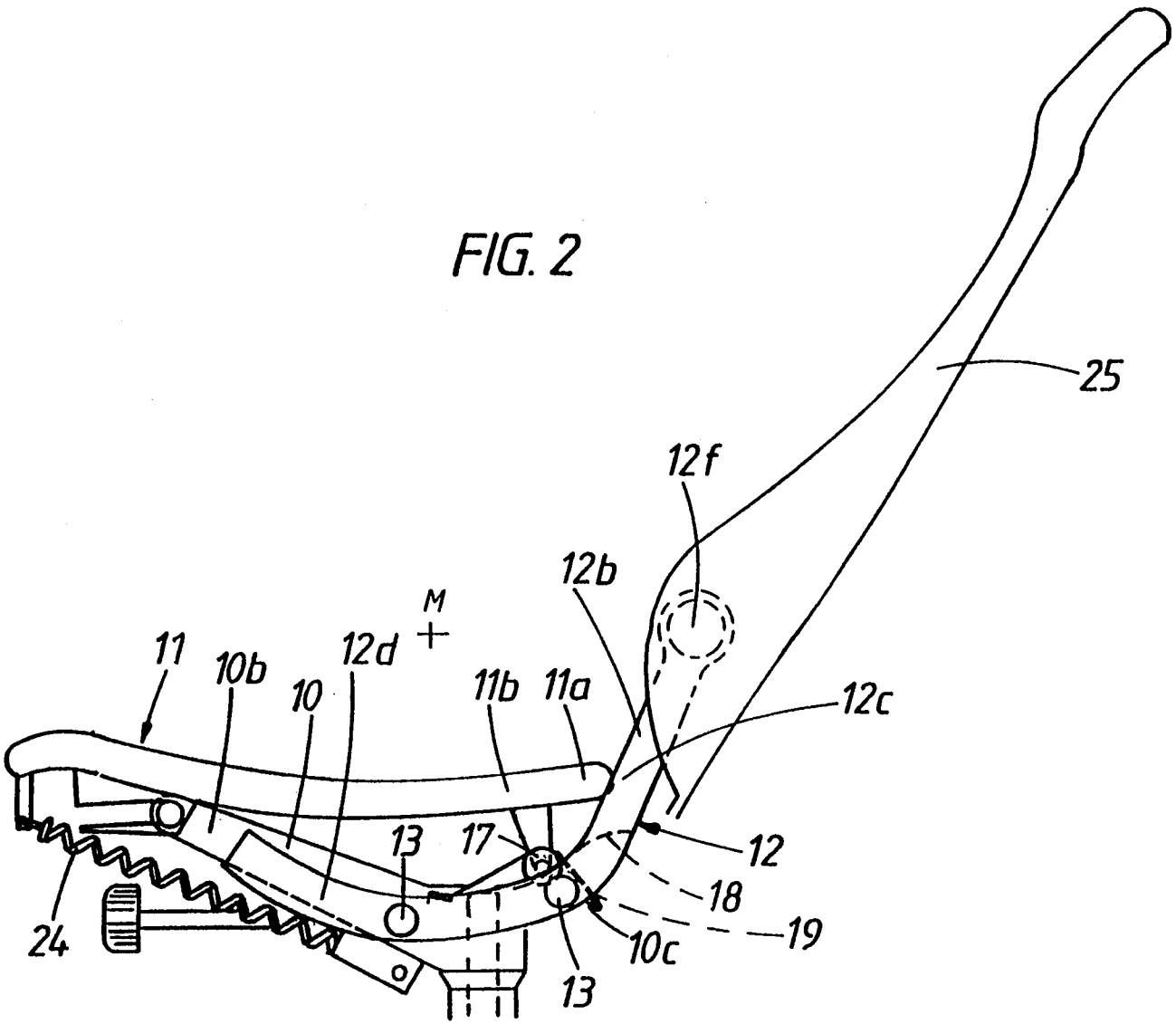
FIG. 2 shows the chair of FIG. 1 in its reclined position.

As is apparent from FIGS. 1 to 3 the backrest carrier 12 has in its bottom portion 12*a* at least one guide slot 12*d*, which extends along an arc of a circle and is guided on at least two bearings 13, which are fixed to the frame 10. The radius of the arc of a circle permits a movement about the imaginary axis mentioned hereinbefore. Alternatively, the backrest carrier 12 may be provided on its bottom portion 12*a* with a guide sleeve, which extends along an arc of a circle and in which a horn extends, which is fixed to the frame 10 at least at one point and has the same radius as the guide sleeve.

During the shifting movement the seat carrier 11 moves in unison with the backrest carrier 12 but on a path which is independent of that of the backrest carrier. For that purpose the seat carrier 11 is provided on its rear portion 11*b* with at least one roller 17, which rolls on a track 18. From the schematic FIG. 6 it is apparent that a self-centering is effected by the symmetrical roller 17, which is guided on an axle 11*c* fixed to the seat carrier 11. For that purpose the track 18 provided on the frame 10 has at the center of its width a longitudinal groove 18*a*, and the roller 17 has at mid-length a longitudinal and radial rib 17*a*, which extends into the groove 18*a*. The roller is elongate and the diameter of the roller 17 is largest at the radial rib 17*a* and linearly decreases toward both ends. As a result, the surface of the roller contacts the track 18 only on a small area and the roller will tend to center itself from any off-center position because owing to the outwardly decreasing diameter of the elongate roller the latter will be constrained to reset when it has a larger contact diameter on one side as a result of a lateral movement.

Figure 4:
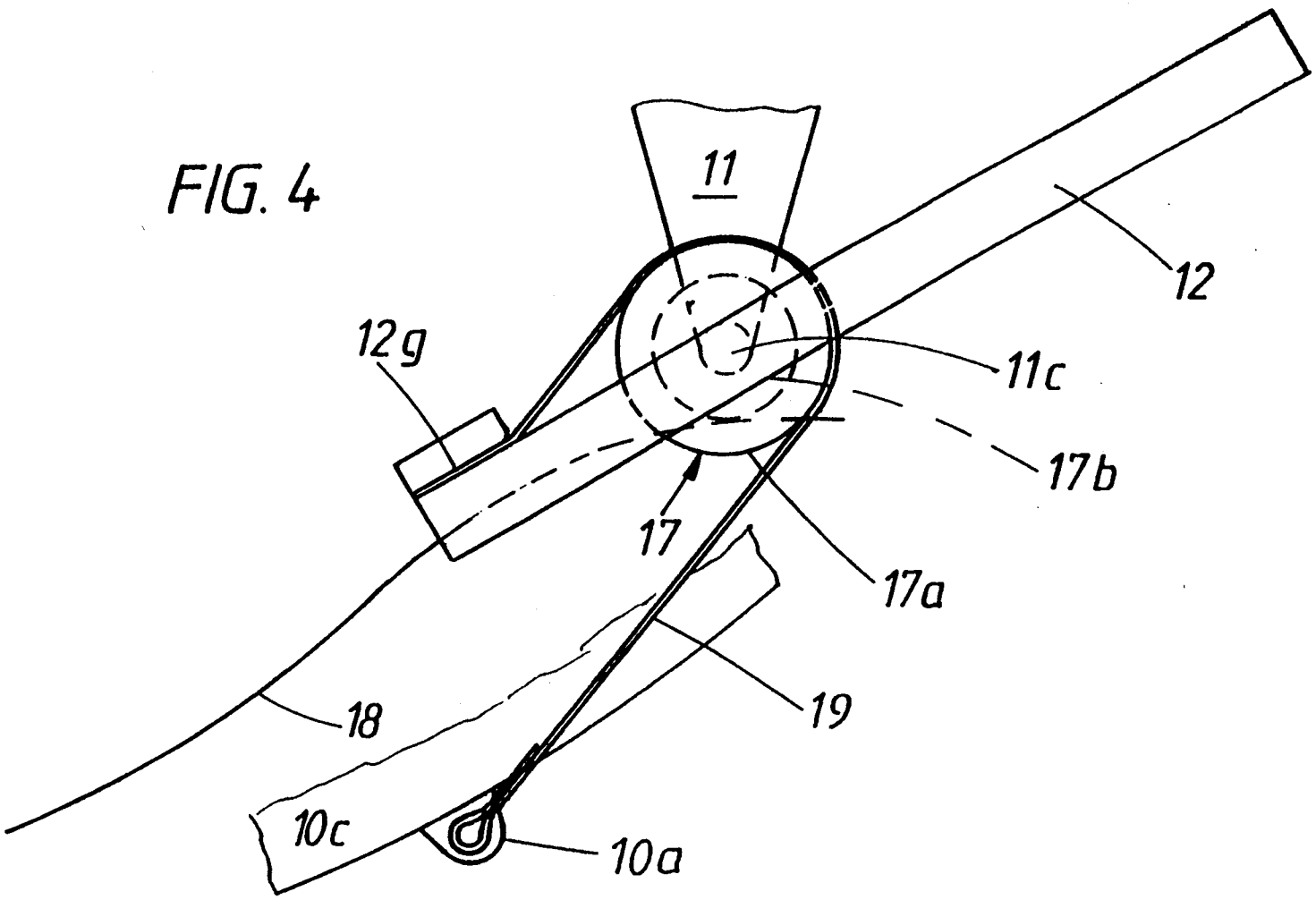
FIGS. 4 and 5 show on a larger scale schematically the mechanism for actuating in position for work and in the reclined position, respectively.
Figure 5:
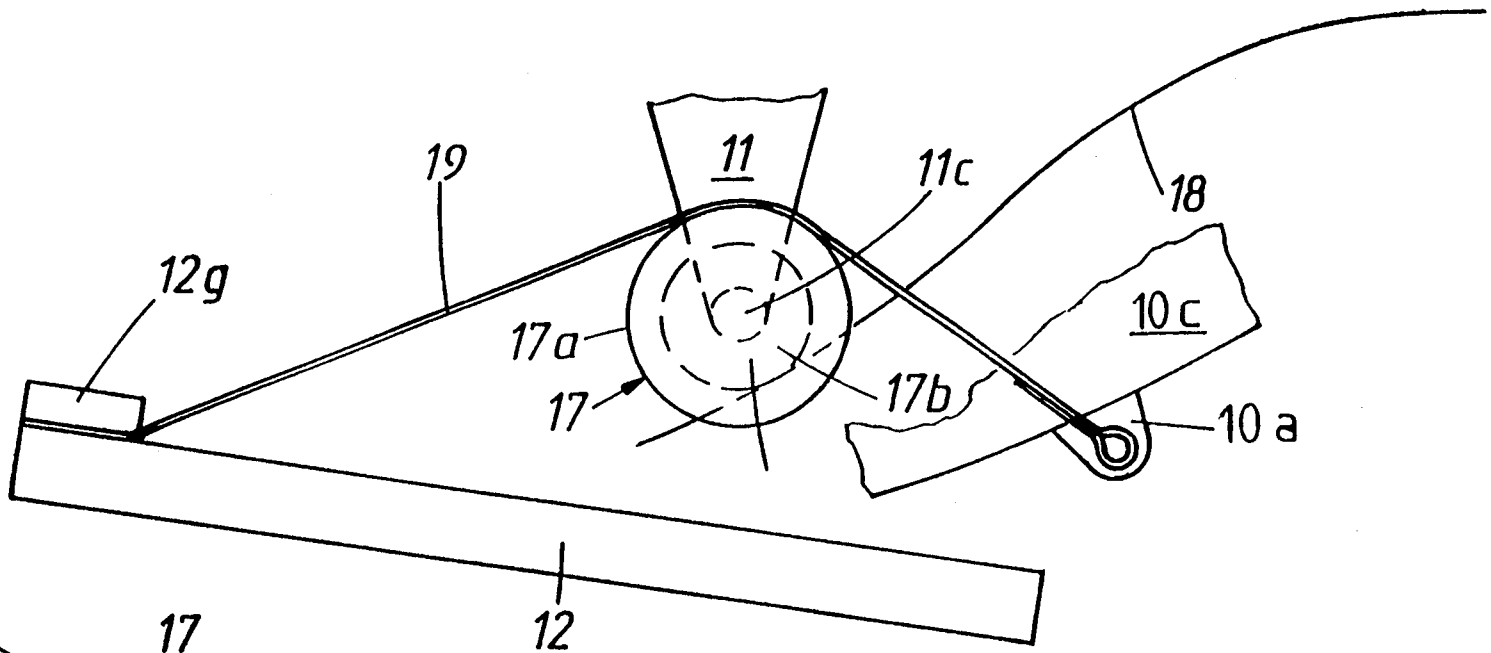

The track 18 is undulated (FIGS. 4, 5). From the point in contact with the roller 17 when the chair is reclined the track is first convexly curved and subsequently concavely curved. As a result, a resistance will be presented to the tendency of the chair to sag under load along the arc. Besides, the relative movement between the seat carrier and the backrest carrier will be increased at the very beginning of the reclining movement so that the shirt of the user will virtually be pulled down.

Figure 6:
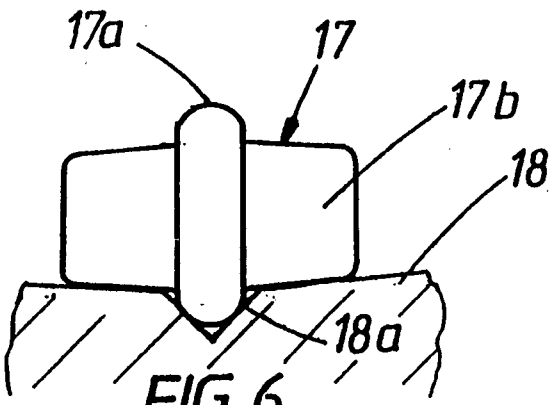
FIG. 6 is a schematic side elevation showing the roller and the track, which is shown in section, of the mechanism shown in FIG. 5.

It is apparent from FIGS. 4 to 6 that the backrest carrier 12, the seat carrier 11 and the frame 10 are interconnected by a flexible tensile element consisting of a belt 19, which is secured to the backrest carrier 12 adjacent to the arcuate guides 12*d* and is secured to the rear edge 10*c* of the frame 10. In that case the elements consisting of the seat carrier 11, the backrest carrier 12 and the frame 10 are operatively interconnected. Alternatively, a preferably rope- or beltlike flexible tensile element may be secured to two of said three parts and may movably be connected to the third part.

If the seat carrier 11 and the backrest carrier 12 are indirectly connected by a flexible tensile element, the latter must be tensioned in all positions of the chair. This is ensured by a proper design of the track 18. In dependence on the position of the flexible tensile element in contact with the outside or inside radius of the arcuate member, the pivotal movement imparted to the backrest carrier will be overproportional to a larger or smaller degree. The axle 11*c* secured to the seat carrier 11 is wrapped at least in part by the flexible tensile element in the clockwise or counterclockwise sense so that an additional possibility of a fine adjustment of the movements is provided.

Figure 7:
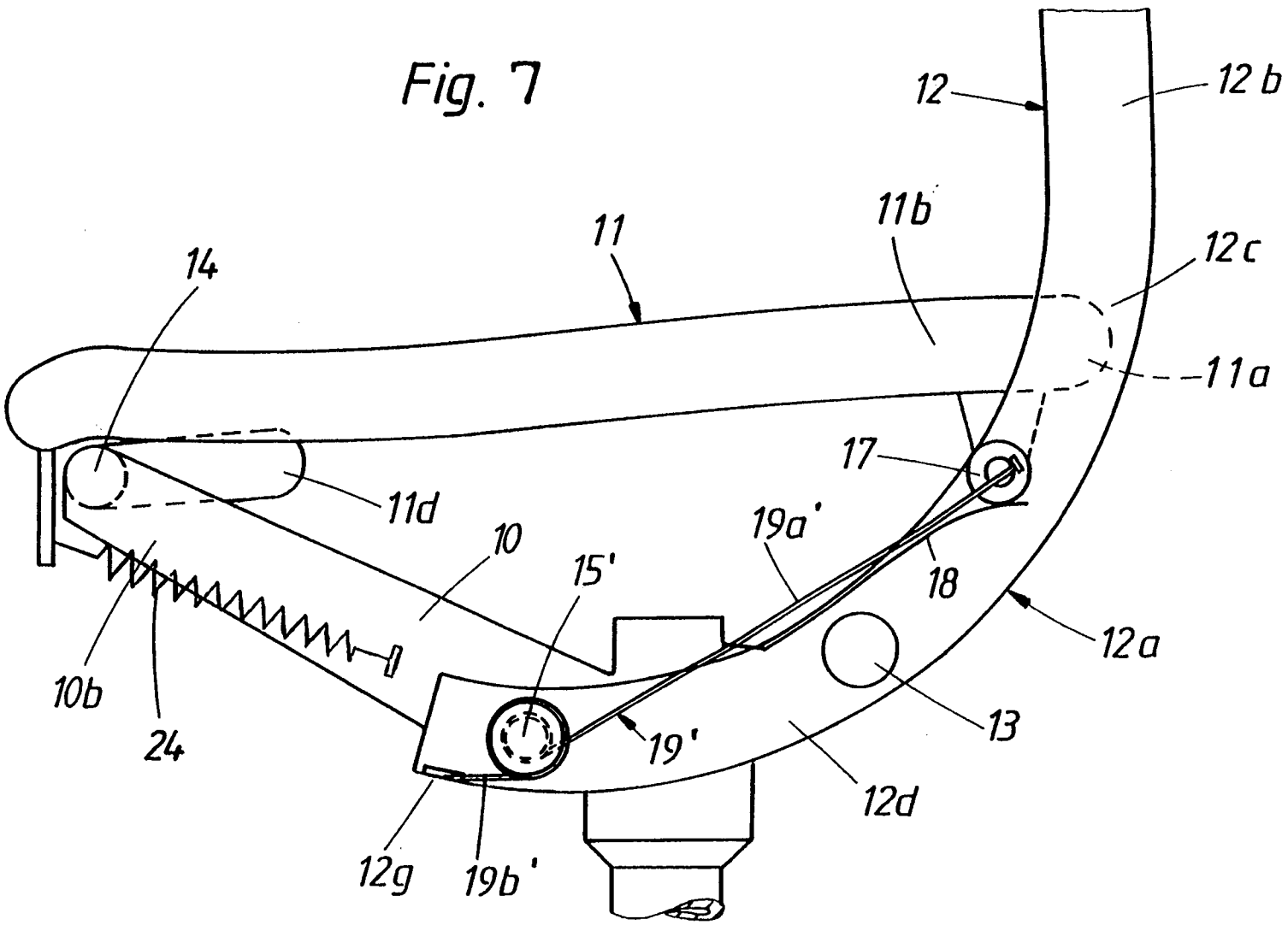
FIG. 7 is an enlarged view showing a detail of FIG. 1 in a view that is similar to FIG. 1 and illustrates an additional connecting element.
Figure 8:
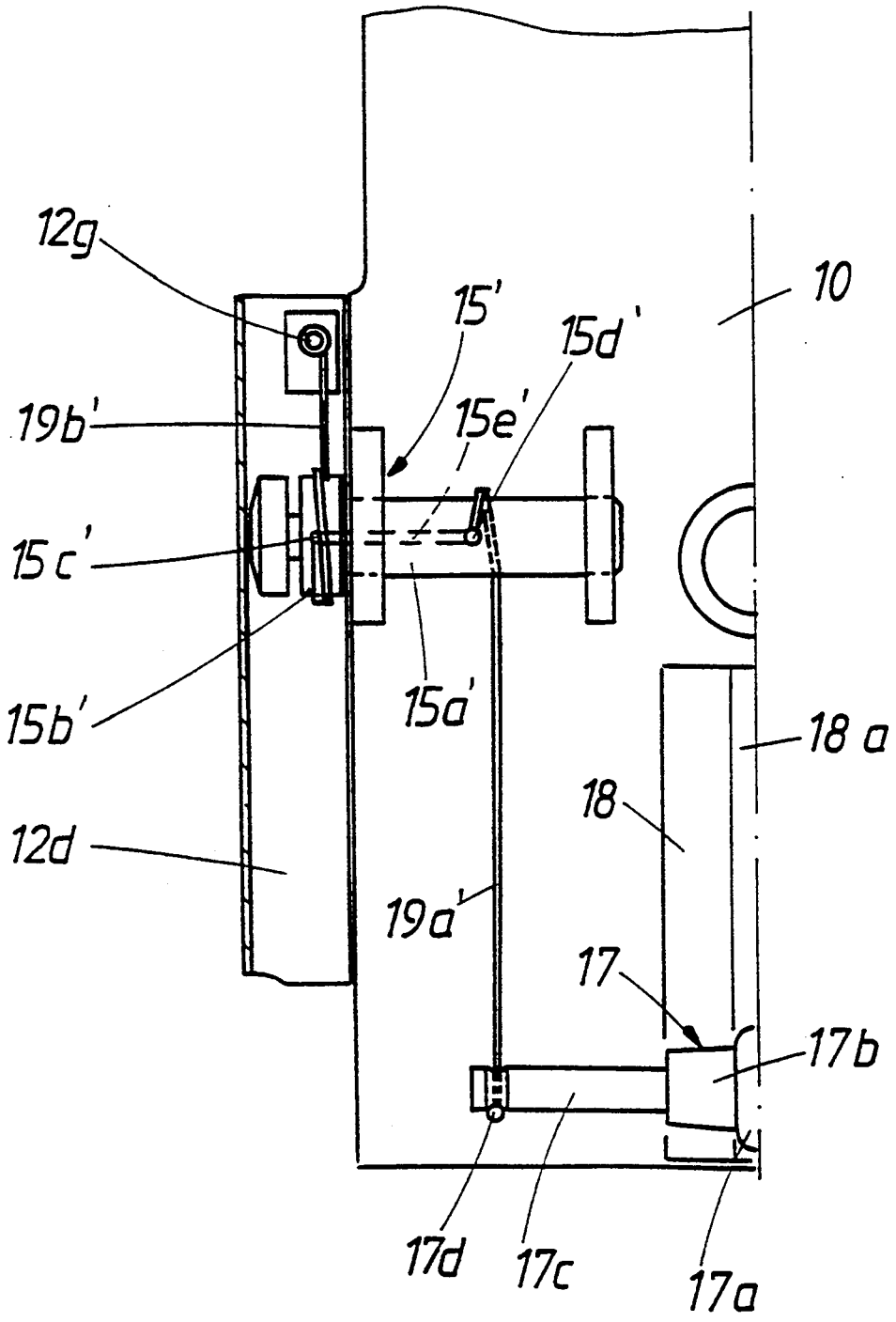
FIG. 8 is a schematic top plan view showing the left-hand half of the chair. For the sake of clarity, the upper part of the arcuate guide for the backrest carrier has been omitted.

FIGS. 7 and 8 show another flexible tensile element consisting of a rope 19', which has a forward portion 19*b'* that is pivoted to the backrest carrier 12 at a pivot 12*g*. A rear portion 19*a'* of the rope is pivoted to the seat carrier 11 on a recessed portion 17*d* of an axle 17*c* for the guide roller 17.

The rope 19' is connected to the frame 10 by an axle 15', which is fixed to the frame 10 and which carries a roller, which has the same diameter as the guide roller 13. The two portions 19*a'* and 19*b'* of the rope 19' are connected to the axle 15'. The axle 15' has an inner section, which is disposed on the outside of the arcuate guide slot 12*d* of the backrest carrier, and an outer section, which is disposed on the inside of the arcuate guide 12*d*. That rear portion 19*a'* of the rope 19' which is connected to the seat carrier 11 is wound up on and unwound from the inner section 15*a'*. At the same time the forward portion 19*b'* connected to the backrest carrier 12 is unwound from or wound up on the outer section 15*b'*.

During a shift to the reclined position the rear portion 19*a'* of the rope is wound up and the forward portion 19*b'* of the rope 19' is unwound because in that case the guide roller 17 for guiding the seat carrier on the track 18 is approaching the fixed axle 15. The outer section 15*b* of the axle 15 is larger in diameter than the inner section 15*a* so that the relative movement of the backrest carrier and the seat carrier will be coordinated and the rope portions will always be tensioned.

The axle 15' mounted on the frame 10 has a central bore 15*e'* which is accessible through radial openings 15*c'*,15*d'*. Owing to the provision of that bore, a single rope may be pivoted to all three parts. During the manufacture of the chair the rope is inserted into the bore 15*e'* through one radial opening 15*d'* and exits through the other radial opening 15*c'*. To make the bore 15*e'*, the axle 15' is drilled from one end; the radial bores are drilled thereafter. As the chair is assembled the inner section 15*a'* of the axle 15 is mounted on the frame 10. Thereafter the backrest carrier is slidably fitted on the protruding portion of the axle 15' and on the guide roller 13, whereafter the outer section 15*b'* of the axle 15' is secured to the inner section 15*a'* by screw threads. If the axle 15' constitutes also a guide roller 13 for cooperating with the arcuate guides 12*d* of the backrest carrier 12 (FIG. 7), the backrest carrier may additionally drive the stationary axle and may thus move the seat carrier.

Figure 10:
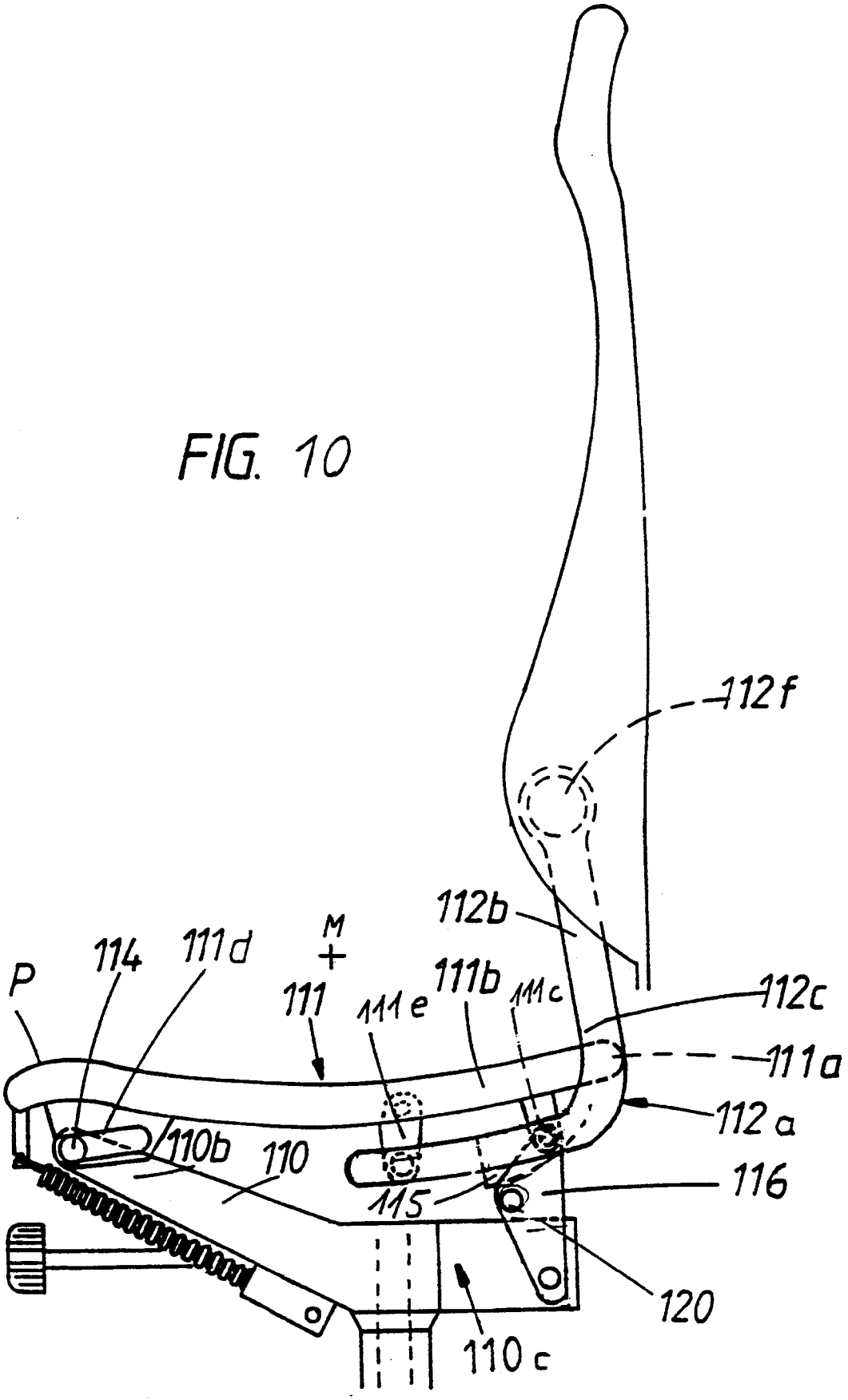
FIG. 10 is a view that is similar to FIG. 1 and shows another embodiment of the chair.

In the second embodiment shown in FIG. 10 the rear portion 111*b* of the seat carrier 111 is pivoted by the pivot 111*c* to at least one cam follower lever 116, which is pivoted to the frame 110. That lever 116 is actuated by the backrest carrier 112. The backrest carrier 112 is connected to the seat carrier 111 by a connecting element and is provided at its bottom end 112*a* with a cam 115, which engages a cam follower roller 120 mounted on the lever 116. The lever 116 is slightly forwardly and downwardly inclined when the backrest carrier 112 is in its steep position, during the reclining movement the lever 116 is actuated by the then descending backrest carrier 112 to initiate the forward movement of the seat carrier 111. During that operation the cam integrally formed with the backrest carrier applies pressure to the cam follower roller 120 so that said parts are in rolling contact with each other. In dependence on the design of the cam 115, the seat carrier may separately be lowered so that the cam 115 may have a shape which is similar to that of the track 18.

Figure 11:
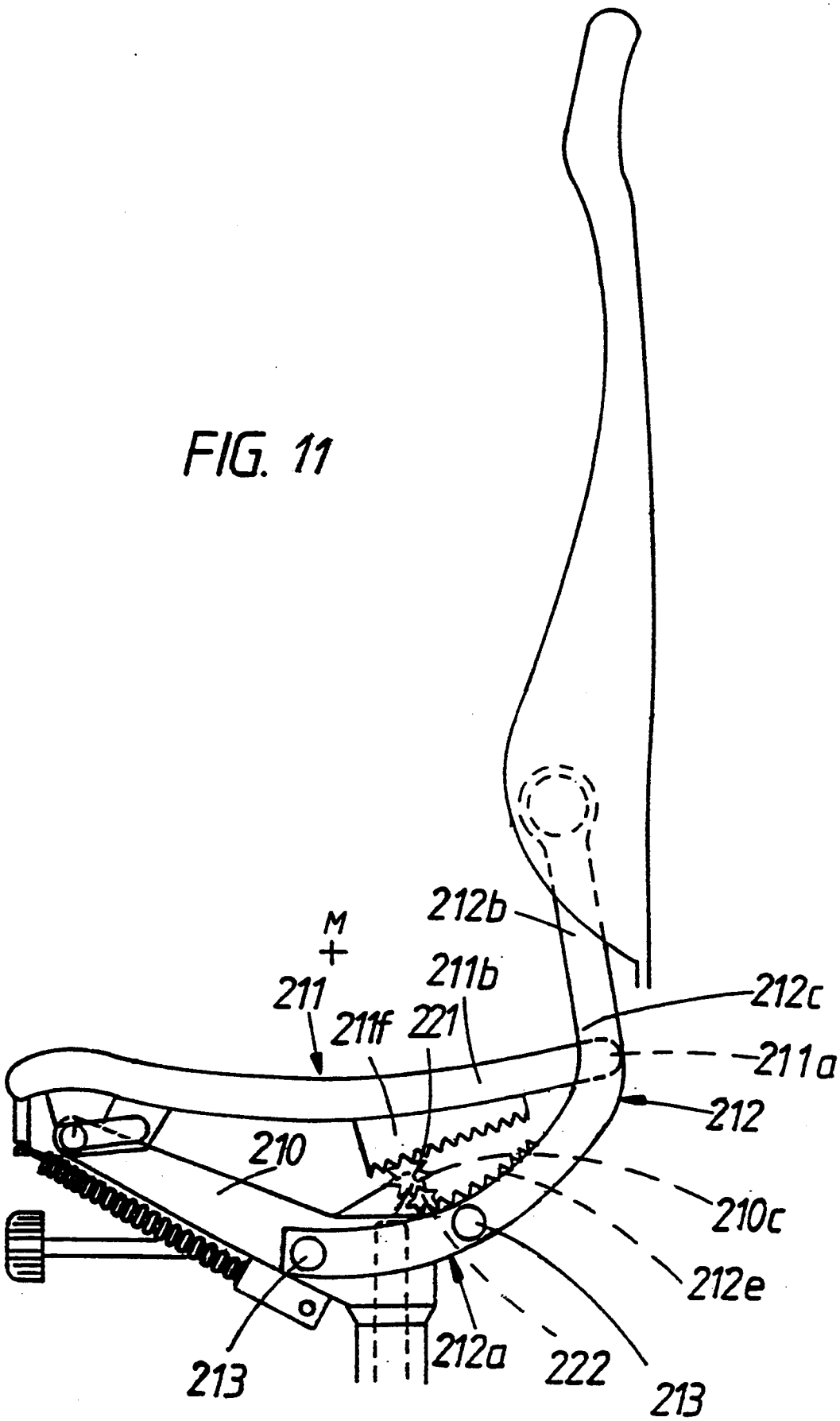
FIG. 11 is a view that is similar to FIG. 1 and shows a third embodiment of the chair.
Figure 12:
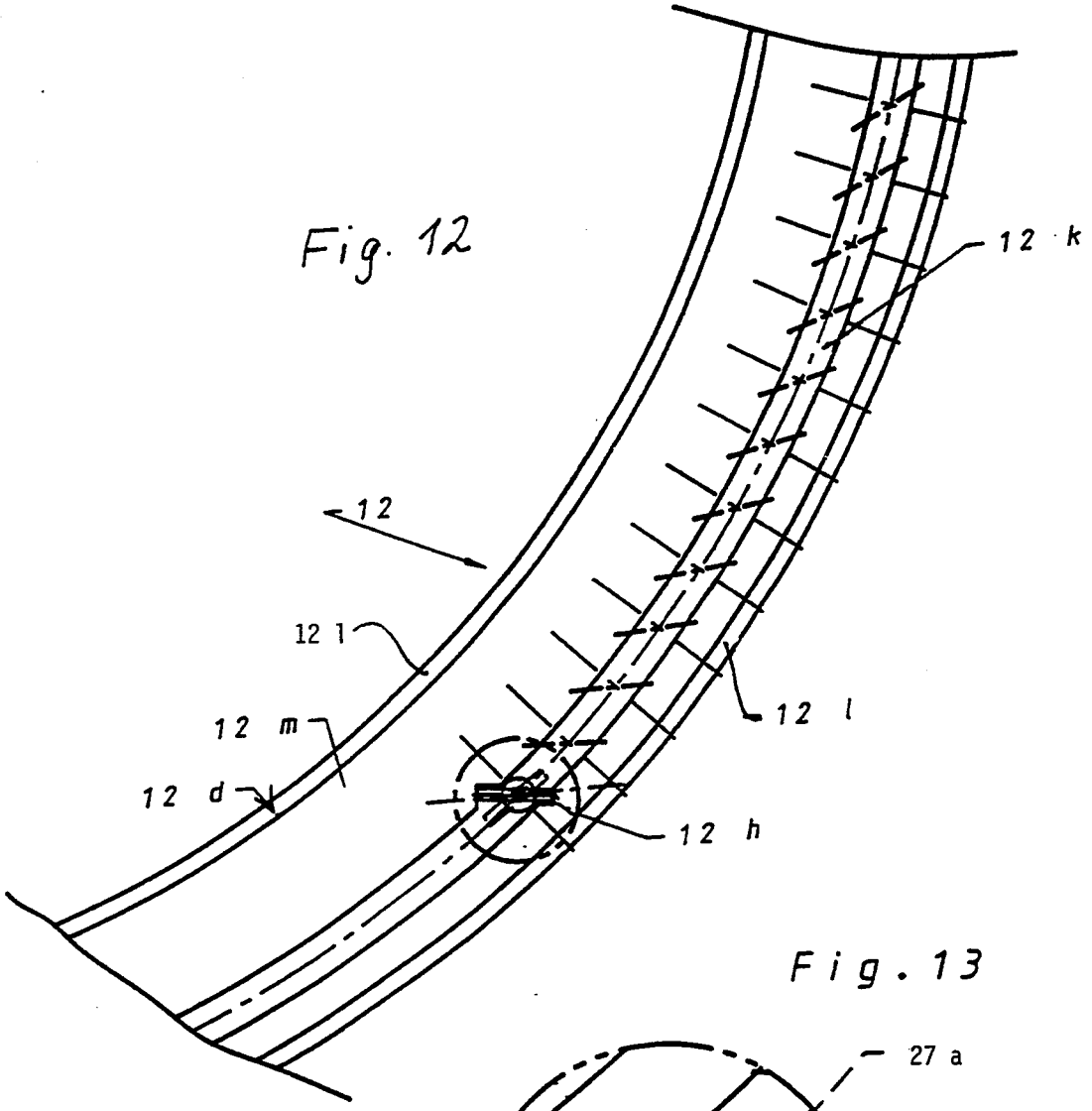
FIG. 12 is an enlarged view showing a track rail as a detail.
Figure 13:
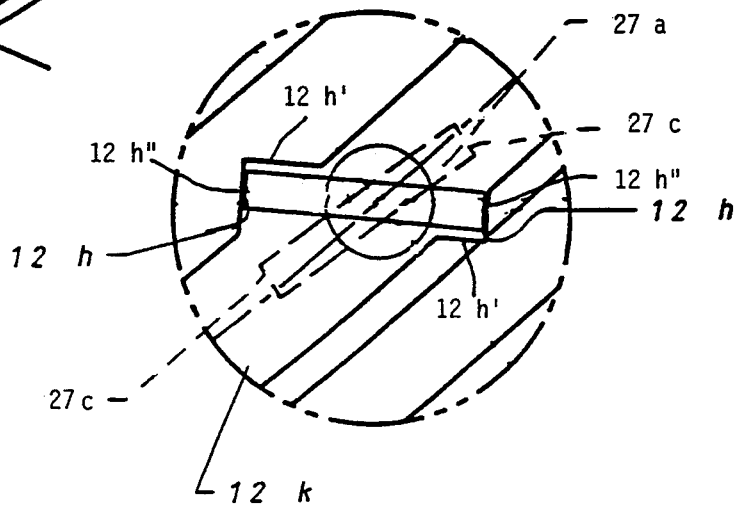
FIG. 13 is an enlarged view showing a section of the track rail of FIG. 12 and an associated adjustable locking member.

Such a simulation of the track 18 may also be adopted in the third embodiment shown in FIG. 11. In that case, racks 211*f* and 212*e* are associated with the backrest carrier 212 and the seat carrier 211, respectively, and mesh with at least one pinion 221, 222. Two pinions having different pitch diameters may be used or the tooth pitches of each pinion and the associated rack may be different so that an overproportional pivotal movement will also be imparted to the backrest carrier.

In an embodiment not shown on the drawing the seat carrier 11 may be guided only st the forward end 10*b* of the frame 10 by two guides, which take up the weight of the seat carrier 11 and which impart to the seat carrier the desired movement relative to the backrest carrier. In that case it will only be necessary to establish by any suitable means, such as the belt 19, an indirect connection between the seat carrier and the backrest carrier. In that case an indirect connection may also be established by an elastic spring, preferably a metal tongue, which is designed for a sufficiently large number of load cycles and permits a separate shifting of the seat carrier.

Figure 9:
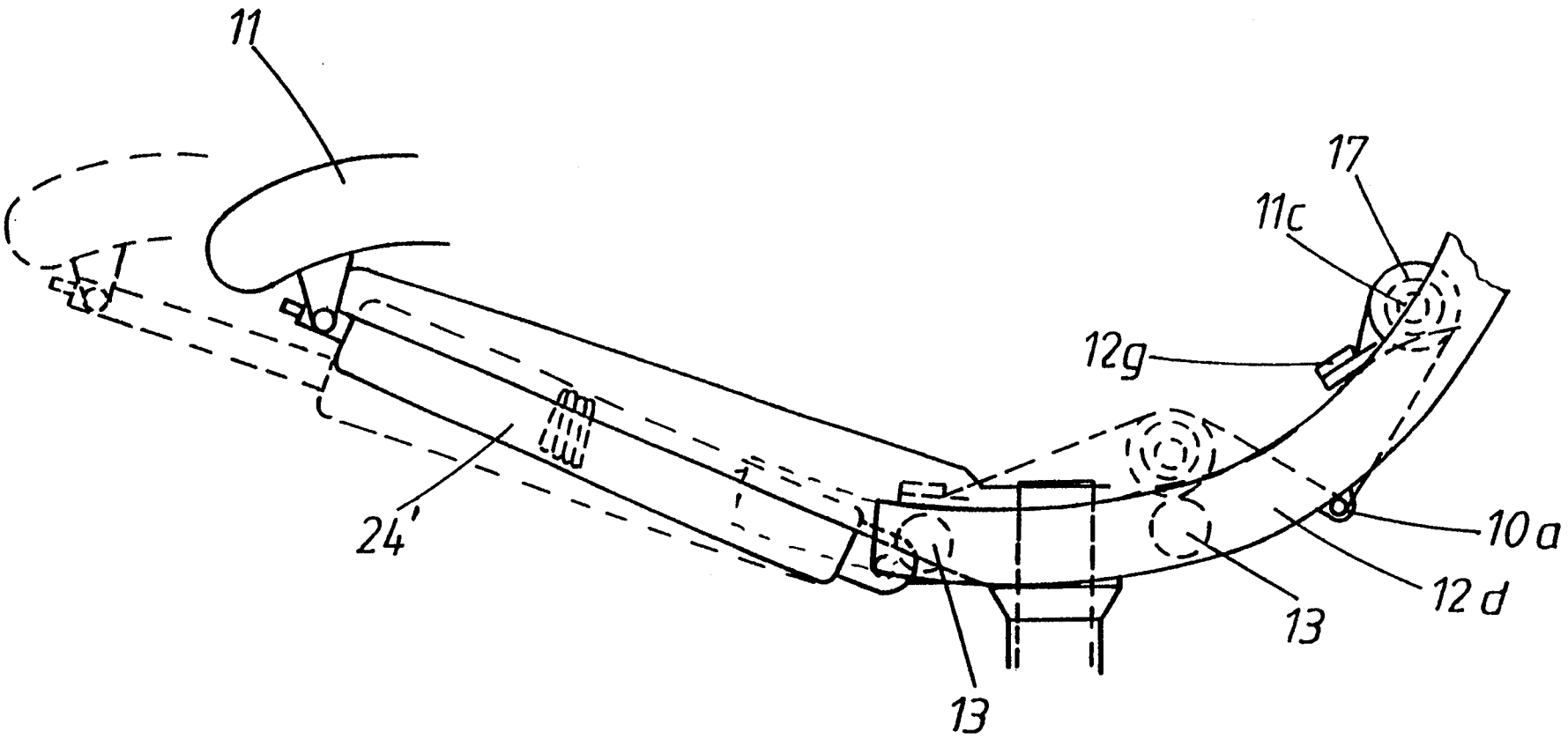
FIG. 9 is an enlarged view showing the lower portion of FIG. 3.

Particularly in the first embodiment the reclining chair can easily be balanced in any position which it can assume. Nevertheless the reclining movement may be effected against the force of a (compression or tension)

spring 24 or a gas spring 24' (FIG. 9), which acts on the frame 10 and on the forward end of the seat carrier 11.

In all illustrative embodiments the maximum angular movement of the backrest carrier between its reclined position and its steep position is about 2.5 times the angle $\beta$ of the accompanying angular movement of the seat carrier 11 or 111 or 211. To permit the chair to be held in any desired position, the guides, preferably the guide 12*d* or the guide slot 11*d* of the seat carrier, may be formed with longitudinally spaced apart recesses 12*h*. Said recesses are adapted to receive an adjustable locking member 27, which has a pivot that is transverse to the guide slot 12*d* and enters the latter. During the shifting movement the position of the locking member 27 relative to the guide is changed so that the locking member can pivotally move into a selected one of the recesses 12*h*.

The pivot 26 of the adjustable locking member 27 is fixed to the frame 10, and the backrest carrier 12 is provided with the arcuate guide slot 12*d*, in which the guide rollers 13 are slidably mounted, or through a second guide slot 12*k* formed in the bottom 12*m* of the guide slot 12*d* and having an area which is approximately one-half of the surface area of the bottom 12*m*. The recesses 12*h* may be formed in the side faces 121 defining the guide slot 12*d* or in the side faces defining the guide slot 12*k*. In the latter case the bottom 12*m* of the guide slot 12*d* is used also as detent element. In either case the mutually offset recesses formed on both sides of the guide slot are regularly spaced apart and the diagonal distance between the recesses on opposite sides equals the length of the locking member 27 inclusive of its two pivoted arms 27*a*. In its non-locking position the locking member 27 may be approximately parallel to the side faces 121 which define the guide slot 12*k* so that the locking member 27 can then slide in the guide slot 12*k*.

In the locked position a side face 27*b* of each pivoted arm 27*a* engages a side edge of a recess 12*h*. As is apparent, the locking action is due to the engagement of the end faces 27*c* of the pivoted arms 27*a* with the respective other side face 12*h*'' of the recess 12*h*. The pivotal movement is effected through about 45° and causes the rectangular pivoted arms 27*a* to move into the triangular recesses 12*h*.

Figure 14:
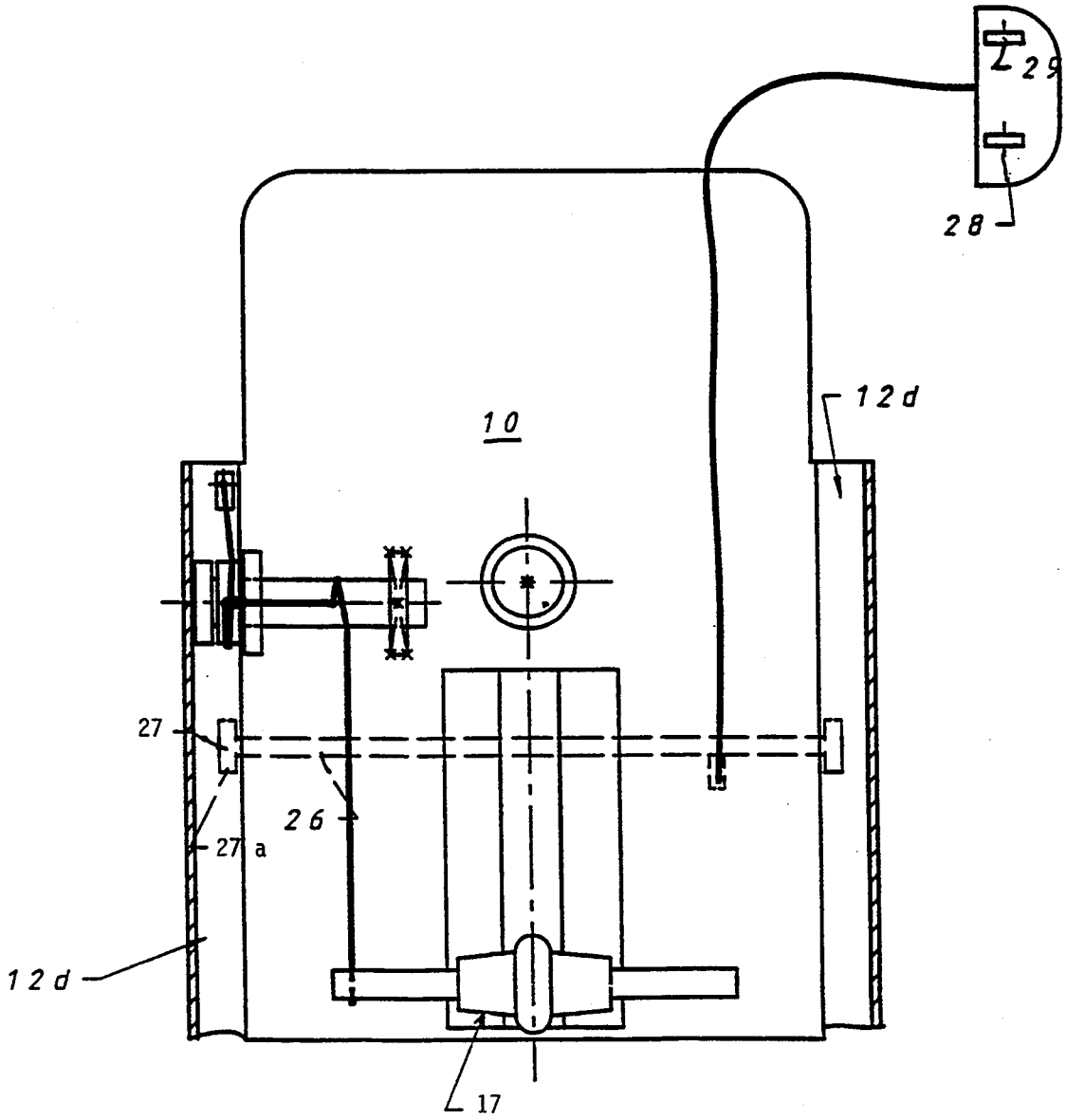
FIG. 14 is a top plan view showing the adjustable locking mechanism provided on the frame.

As is apparent from FIG. 14 the pivotal movement of the locking member 27 is initiated by a lever 28, which is disposed under the seat of the chair and is biased by a spring tending to return the lever to its locking position. But that lever can also be locked in its inoperative position.

I claim:

1. In a reclining chair comprising a frame, a seat carrier having a rear portion and movably mounted on said frame, a backrest carrier, which has a bottom portion extending under said seat carrier and an intermediate portion adjacent to said rear portion of said seat carrier and is movably mounted on said frame and is adapted to perform a shifting movement between a relatively steep position and reclined position, in which said bottom portion is on a lower level than in said steep position, and connecting means connected to said seat carrier and to said backrest carrier and arranged to impart to said seat carrier relative to said frame a forward movement and to lower at least said rear portion of said seat carrier in response to and during said shifting movement to said reclined position, the improvement residing in that said seat carrier and said backrest carrier are connected to said connecting means at respective spaced apart points of said connecting means, and guiding means are provided for guiding said seat carrier and said backrest carrier independently of each other relative to said frame along mutually independent paths during said shifting movement.

2. The improvement set forth in claim 1 as applied to an office swivel chair.

3. The improvement set forth in claim 1, wherein said connecting means comprise a belt.

4. The improvement set forth in claim 1, wherein said connecting means comprise a spring.

5. The improvement set forth in claim 1, wherein said connecting means comprise a gear train.

6. The improvement set forth in claim 1, wherein said backrest carrier is arranged to move from said steep position toward said reclined position in response to pressure applied by the back of a person sitting on said seat carrier to said backrest carrier.

7. The improvement set forth in claim 1, wherein said guiding means are arranged to guide said bottom portion of said backrest carrier along an arcuate path during said shifting movement.

8. The improvement set forth in claim 7, wherein said guiding means are arranged to constrain said backrest carrier to perform said shifting movement about an imaginary axis, which extends through the hip joints of a person sitting on said seat carrier, said seat carrier has a portion which constitutes the highest point of said seat carrier in its position corresponding to said steep position of said backrest carrier and defines a predetermined horizontal plane in said position and said guiding means are arranged to prevent a movement of said seat carrier above said horizontal plane.

9. The improvement set forth in claim 1, wherein said guiding memos comprise a guide slot provided on said seat carrier and at least one pin, which is fixed to said frame and slidably mounted in said guide slot.

10. The improvement set forth in claim 1, wherein said guiding means comprise at least one guide slot, which is provided on said bottom portion of the backrest carrier and extends along an arc of a circle, and at least two bearings, which are fixed to said frame and movably mounted in said guide slot.

11. The improvement set forth in claim 1, wherein said frame is provided with a track formed in the center of its width with a longitudinally extending groove, said seat carrier is provided with an axle, on which a symmetrical roller is rotatably mounted, which has at the center of its axial extent a radial rib extending into said groove.

12. The improvement set forth in claim 11, wherein said roller is elongate and has its largest diameter at said rib and linearly decreases in diameter from said rib toward both ends, said track is undulated and has a convexly curved portion and a concavely curved portion longitudinally succeeding each other and said roller is arranged to contact said track on said convexly curved portion at a distance from said concavely curved portion when said backrest carrier is in said reclined position and to contact said track at said concavely curved portion at a distance from said convexly curved portion when said backrest carrier is in said steep position.

13. The improvement set forth in claim 1, wherein said connecting means comprise a flexible tensile element, which is fixed to two of the three parts consisting of said frame, said seat carrier, and said backrest carrier and is at least relatively movably connected to the third of said parts.

14. The improvement set forth in claim 13, wherein said flexible tensile element consists of a rope.

15. The improvement set forth in claim 13, wherein said flexible tensile element consists of a belt.

16. The improvement set forth in claim 13, wherein said two parts consist of said seat carrier and said backrest carrier and said frame is provided with a rotatably mounted, fixed axle, which is at least partly wrapped by said flexible tensile element for movably connecting said flexible tensile element to said frame.

17. The improvement set forth in claim 16, wherein said axle comprises an inner section and an outer section, which is larger in diameter than said inner section, said flexible tensile element comprises a rear portion, which is connected to said seat carrier and arranged to be unwound from said inner section of said axle during said shifting movement of said backrest carrier from said reclined position to said steep position, and also has a forward portion, which is connected to said backrest carrier end arranged to be wound up on said outer section of said axle during said shifting movement to said steep position, and said axle is arranged to guide and to be driven by said backrest carrier during said shifting movement.

18. The improvement set forth in claim 16, wherein said flexible tensile element comprises rope means, said axle is formed with a central bore, which extends in both said sections, and with angularly spaced radial openings leading from said bore to the outside, and said rope means extend through said openings into said bore.

19. The improvement set forth in claim 1, wherein a lever is pivoted to said frame and to said rear portion of said seat carrier and is provided with a cam follower and said backrest carrier is provided with a cam for cooperating with said cam follower.

20. The improvement set forth in claim 1, wherein said guiding means comprise guide slot means, which are provided on one of the parts consisting of said seat carrier and said backrest carrier and are provided with longitudinally spaced apart recesses, an adjustable locking member is provided, which has a pivot extending into said guide slot means and arranged to move relative to said guide slot during said shifting movement and said locking member is pivotally movable about said pivot into any of said recesses in said guide slot to lock said chair in an intermediate position.

21. The improvement set forth in claim 19, wherein said backrest carrier is provided with guide slot means which extend along an arc of a circle and have mutually opposite side faces formed with said recesses, which are regularly spaced apart and angularly staggered, two laterally spaced apart bearings are fixed to said frame and extend through and are slidable in said guide slot means, and said pivot extends through said guide slot means.

22. The improvement set forth in claim 20, wherein said guide slot means comprise a first guide slot defined by a bottom surface and with a second guide slot formed in said bottom surface and having an area which is about one-half of the area of said bottom surface and defined by said side faces formed with said recesses, said bearings extend through said first guide slot and consist of guide rollers, and said pivot extends through said second guide slot.

23. The improvement set forth in claim 1, wherein said connecting means comprises a flexible tensile element fixed to said frame, said seat carrier and said backrest carrier.

24. The improvement set forth in claim 1, wherein said connecting means and said guiding means are arranged to lower said intermediate portion of said backrest carrier to an at least slightly larger extent than said rear portion of said seat carrier.

* * * * *